United States Patent [19]

Kern et al.

[11] 4,123,628

[45] Oct. 31, 1978

[54] TIMER SWITCH ASSEMBLY

[75] Inventors: Kenneth E. Kern; James W. Richmond, both of Charlotte, N.C.

[73] Assignee: General Time Corporation, Thomaston, Conn.

[21] Appl. No.: 654,949

[22] Filed: Feb. 3, 1976

[51] Int. Cl.[2] ..... H01H 43/10

[52] U.S. Cl. ..... 200/38 FB; 200/38 D; 200/38 DA

[58] Field of Search ..... 200/33 R, 38 R, 38 FA, 200/38 FB, 38 B, 38 D, 38 DA, 38 DB, 38 DC

[56] References Cited

U.S. PATENT DOCUMENTS

| | | | |
|---|---|---|---|
| 1,471,314 | 10/1923 | Souder | 58/46 R |
| 2,440,142 | 4/1948 | Elliott | 200/38 FB |
| 2,905,776 | 9/1959 | Eisenberg et al. | 200/38 DA X |
| 3,254,166 | 5/1966 | Rulseh et al. | 200/38 FB |
| 3,260,807 | 7/1966 | Rulseh et al. | 200/38 D X |
| 3,383,479 | 5/1968 | Laszlo | 200/38 DA |
| 3,522,393 | 7/1970 | Banathy et al. | 200/38 FB |
| 3,588,391 | 6/1971 | Banathy et al. | 200/38 D |
| 3,825,872 | 7/1974 | Sadler et al. | 337/301 |
| 3,902,311 | 9/1975 | Chacon et al. | 58/23 AC |
| 3,914,951 | 10/1975 | Heidorn | 200/38 B X |
| 3,917,165 | 11/1975 | Cross | 236/46 R |
| 3,948,441 | 4/1976 | Perkins et al. | 236/46 R |

*Primary Examiner*—James R. Scott
*Attorney, Agent, or Firm*—Pennie & Edmonds

[57] ABSTRACT

The timing apparatus includes timer motor means having a rotatable output shaft rotatable through a revolution in a prescribed period of time, switching means adapted to be alternately switched between at least two discrete positions for respectively operating corresponding electrical output devices, indicating means operatively connected to the output shaft for movement in unison with the output shaft and for selective independent movement with respect to the output shaft in response to manual adjustment for adjustably setting the times at which the switching means will be operated to effect such switching between the electrical output devices, and actuating means operatively connected to the switching means and adapted for periodic movement between opposed first and second positions in response to displacement of the indicating means. Each of the motor means, switching means and actuating means are supported by a supporting member and the output shaft of the motor means extends through the supporting member. The timing apparatus, further includes, biasing means interconnecting said switching means and said actuating means for resiliently snapping and maintaning the switching means in respective discrete positions.

6 Claims, 6 Drawing Figures

TIMER SWITCH ASSEMBLY

BACKGROUND OF THE INVENTION

1. Field of the Invention

In general, the present invention pertains to timing apparatuses which are particularly adapted for use in alternately operating control switches in measured timed sequences. Specifically, this invention is directed to a novel and improved timing apparatus including a switching apparatus for accurately, continuously, and reliably operating electrical devices, such as high and low temperature thermostats for furnaces and the like, in predetermined time sequences notwithstanding shutdowns or other interruptions in electrical power.

2. Description of the Prior Art

Heretofore, it has been relatively well-known in the field of environmental control systems to operate temperature control units for regulating furnaces and other like apparatus for the purpose of providing a variety of operating temperature conditions during certain increments of time. For instance, it is common practice to operate a furnace or heater in a plant, office or home, at one particular temperature level during the day and usually have such furnace turned off during the night. Normally, in these situations, however, during the time such heaters or furnaces start-up and heat the surrounding environment to the desired temperature a significant amount of energy is expended. It has been recognized from the standpoint of energy conservation not to mention environmental comfort that the heaters and furnaces should be consistently and reliably controlled by appropriate temperature control units associated therewith so as to minimize overall energy loss as well as avoid costly start-ups. One approach which has been taken is to operate a furnace during prescribed periods of time during the day and night. However, with imprecise timing control, fuel and/or electrical energy might also otherwise be unnecessarily wasted because, for instance, the desired and relatively economical temperature levels desired during segments of a particular time of the day or night will be unable to be achieved. For example, should a high temperature thermostat be set to operate the furnace at 6 a.m., but, instead, commences operation at 3 a.m., it will be readily evident that the furnace is unnecessarily wasting energy during such time.

One of the earlier attempts to provide a successful day/night temperature controller in this particular field is generally described in U.S. Pat. No. 1,471,314. As disclosed in the above referenced patent, an automatic apparatus includes day and night thermostats for alternate operation and control of a furnace, an adjustable clock, and a switching mechanism for shifting between thermostats at any predetermined time of day or night. Such type of approach, however, suffers from the disadvantages at requiring an overall complicated structural arrangement to achieve the switching. Additionally, the particular switch mechanism which is used to accomplish the switching action between opposed thermostats is relatively complicated in construction and less than entirely satisfactory in use. Aside from the preceding disadvantages, such an apparatus is subject to the shortcomings of being incapable of maintaining the preselected times of operation for the furnace should there be prolonged interruptions of power supplied to the motor mechanism.

Several present day prior art arrangements of the foregoing described category relating to temperature controlling devices are operated by A.C. motors. One such device includes a clock controlled thermostat as more completely described in U.S. Pat. No. 3,825,872. Such clock controlled thermostat uses a common power source for a timepiece and furnace motor. The timepiece provides the timing sequence for switching of the thermostats. The foregoing constructional arrangement, however, presents certain problems since its continual accuracy is also dependent upon freedom from electrical interruptions and other types of power shutdowns. In general though, interruptions and shutdowns of electrical power are relatively frequently widespread. Consequently, there is no assurance that the timepiece will be consistently accurate in precisely actuating the switches at the preselected times. Therefore, this type of noted switching arrangement is unable to successfully perform in the manner intended. Another drawback associated with similar forms of A.C. clock controlled thermostats notwithstanding power interruptions resulting in the power lines is the rather conventional practice to provide furnaces or heaters themselves with safety features that are operable to turn off the power. As a result, the timing motor is similarly turned off. Consequently, the selected timing sequences which the thermostats are intended to follow will be offset. Such offset, as mentioned, may be frequently further compounded by repeated safety shutdowns or other interruptions in power. It will, therefore, be readily evident from the preceding discussion that over relatively prolonged periods of time rather substantial deviations between the desired and actual switching time sequences often develop. In such eventuality, the particular switching systems, of course, are not entirely satisfactory. Moreover, such kind of switching systems define a rather complicated and relatively expensive mechanism to construct and operate within the desired prescribed intervals of time.

A more recent attempt which has been taken to improve over the heretofore generally known prior art is a battery operated thermostat timer. While this particular approach overcomes many of the disadvantages associated with A.C. power in operating a thermostat timer it, too, is also subject to drawbacks. Foremost among these drawbacks is the fact that many batteries do not successfully operate for more than one year. Accordingly, battery replacements become necessary and are expensive over relatively prolonged periods of time.

While a known clock system, as is generally described in U.S. Pat. No. 3,902,311, uses a trickle charger for charging a battery, such system does not, on the other hand, use the trickle charger to maintain the battery as the primary and exclusive source of power for operating the clock.

From the above general description of known types of clock controlled thermostat systems particularly adapted for use in controlling the operation of a furnace in controlled time intervals, it will be appreciated that they suffer from several disadvantages. Primarily such disadvantages are that they fail to continuously, accurately and economically control the switching operations of thermostats by a simplified and highly advantageous timing apparatus in predetermined time intervals, regardless of shutoff in the power supply, and, in a manner which does not require repeated and costly replacement of batteries. Aside from the foregoing described shortcomings, heretofore known mechanisms for accomplishing the foregoing are somewhat complicated in construction and relatively uneconomical in manufacture and are generally unreliable in operation.

SUMMARY OF THE INVENTION

It is an object of the present invention to overcome the several enumerated disadvantages previously described by providing for a novel and improved timing apparatus for continuously and accurately operating a thermostat timer in an economical, simplified and reliable manner.

Briefly stated, the present invention contemplates a timing apparatus for enabling the operation of first electrical means comprising a source of A.C. power in electrical communication with the first means. The invention, further, comprises second means connected to the first means for enabling the actuation and deactuation of the first means in measured time sequences and battery means which electrically communicates with the second means to solely and continuously operate the second means notwithstanding interruptions of power from the power source. The instant invention further includes charging means electrically interconnecting the power source and the battery means for charging the battery means until an interruption in the power supplied by the power source.

In a preferred embodiment, the second means defines an apparatus comprising timer motor means including a rotatable output shaft rotatable through a revolution in a prescribed period of time. The preferred apparatus further contemplates that switch means be connected to the motor means for being alternately moved between at least two discrete positions for respectively operating corresponding electrical output devices. Also envisioned is indicating means operatively connected to the shaft for movement in unison with the output shaft, and for selective independent movement with respect to the shaft in response to adjustment for adjustably setting the prescribed periods of time within which the switch means will be operated to effect the switching. Actuating means serve to operatively connect the timer motor means and the switch means for purposes of periodic movement between opposed first and second positions in response to displacement of the indicating means. In addition, the actuating means resiliently snaps and maintains the switch means in respective ones of the two opposed discrete positions whenever the actuating means is moved to corresponding ones of said first and second positions.

BRIEF DESCRIPTION OF THE DRAWINGS

The above, as well as other objects, features, and advantages of the present invention will become readily apparent upon a reading of a detailed description of a preferred embodiment made in accordance with the principles of the invention when viewed in conjunction with the accompanying drawings wherein like structure throughout the several views will be indicated by like reference numerals.

DETAILED DESCRIPTION

Figure 6:
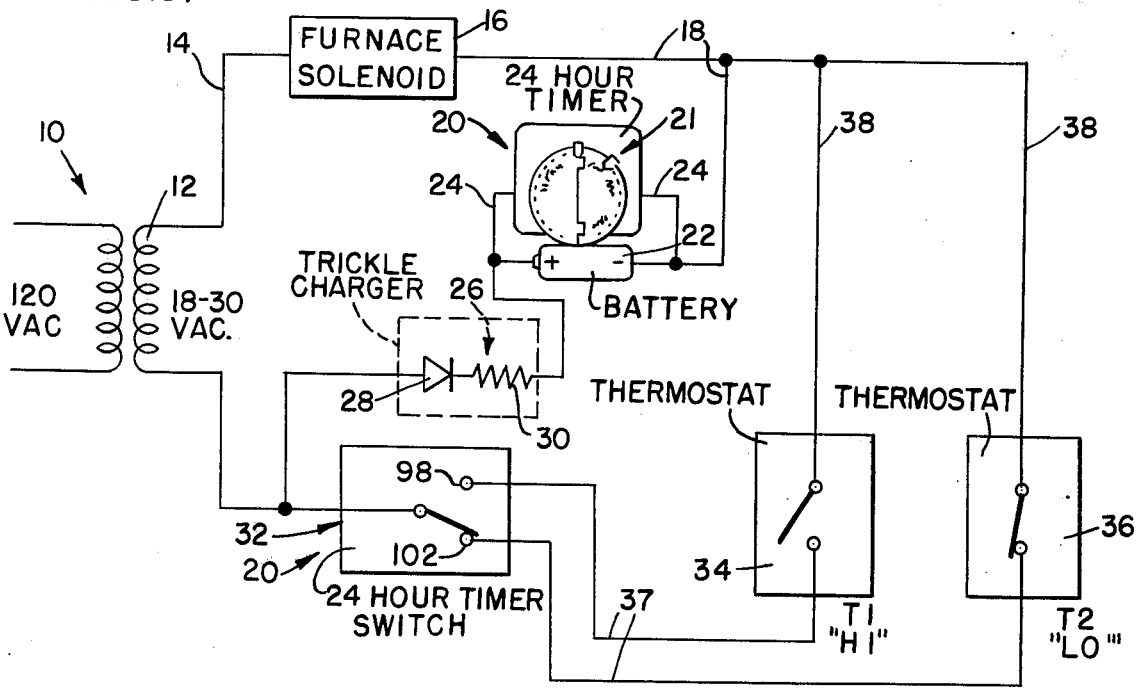
FIG. 6 is a schematic electrical representation for a timing apparatus embodying the principles of the present invention.

With initial reference to FIG. 6, there is perhaps best illustrated the timing apparatus of the present invention being generally designated by reference numeral 10. Timing apparatus 10 is particularly adapted for use in environmental control systems for regulating, within predetermined time intervals, conditions, such as the temperature of air and the like. Such timing apparatus 10 is supplied with power from an incoming source of alternating current (A.C.) power which may be defined by standard coupling transformer 12. Transformer 12 is effective to step down or reduce the voltage to a suitable level for subsequent use and is appropriately connected by communication line 14 to any suitable electrical output means, for example, a furnace solenoid 16. Mention should be made that it is within the spirit and scope of this invention that other types of suitable power plant type devices may also be suitably electrically energized and controlled by apparatus 10. The furnace solenoid 16 is adapted to be continuously operated in response to the A.C. power supplied from the transformer 12.

Also, electrically connected to furnace solenoid 16 by electrical lines 18 is time switching apparatus 20 and timing motor mechanism 21. Further details as to the construction and operation of this particular type of timing switch apparatus will be subsequently set forth in the succeeding description of the present invention.

Battery 22 is used to continuously supply power to the timing motor mechanism 21 by being connected to and thereacross by leads 24. Such battery 22 may be fabricated from a suitable and, preferably, long life conventional type such as alkaline or lead-zinc pen cells or ni-cads to provide either 1.5 volts or 3.0 volts. The battery 22 serves to provide for the proper power output required for the continuous operation of switching apparatus 20 and timing motor 21 should power to timing apparatus 10 suffer from fluctuations and interruptions. Consequently, by virtue of this arrangement, timing mechanism 21 continuously and accurately operates the switching to be subsequently described in correct time intervals. The significance of this particular relationship will become evident.

The present invention contemplates a trickle charger means 26 which essentially is comprised of regulating diode 28 and resistor 30. Diode 28 is operatively electrically connected to transformer 12, as well as the timing mechanism 21. The resistor 30 electrically interconnects the diode 28 with battery 22. Through trickle charger means 26, battery 22 will be continuously charged from power supply 12, provided, of course, there are no interruptions in power. Essentially, trickle charger means 26 serves to provide a rectification or conversion of the alternating current, provided by the power supply 12, to a unidirectional current so that battery 22 may be appropriately charged. The trickle charger 26 thus provides a continuous charge at a relatively slow rate, approximately equal to the internal losses of the battery 22 and is suitable to maintain such battery in a fully charged condition. Cessation of electrical power from the power supply 12 results in the trickle charger 26 being unable to successfully operate. It will be appreciated, therefore, that since the battery 22 is virtually always charged the timing motor 21 can be rather simply, continuously and accurately operated. Also, battery 22 is able to have a significantly increased life span. Therefore, timing apparatus 10 does not require as many battery replacements as would be the situation without trickle charger means 26.

Resumption of the power from power supply 12 to furnace solenoid 16, as well as to trickle charger means 26 again effectively serves to appropriately operate both the solenoid 16 and the trickle charger means 26.

Figure 1:
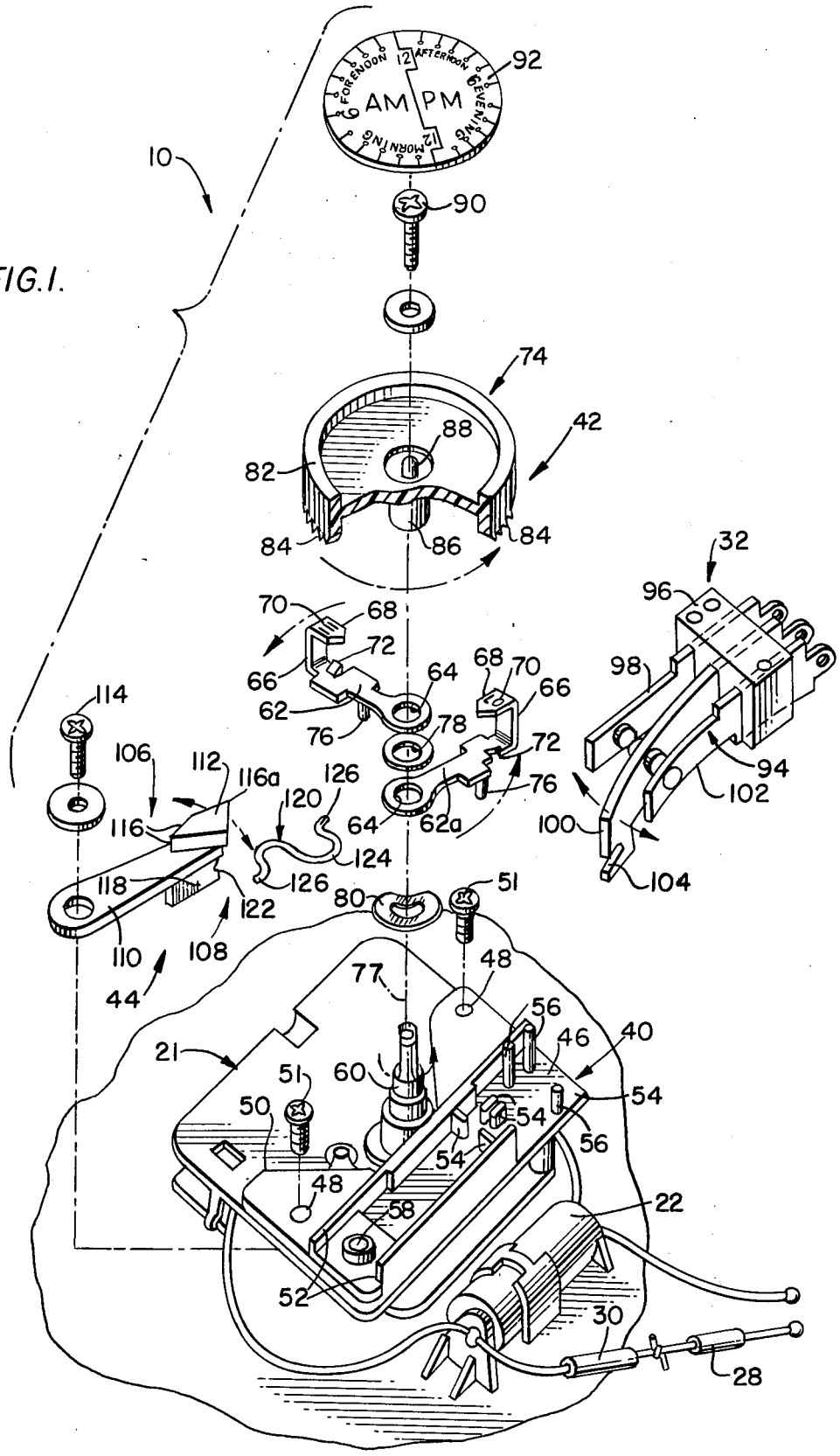
FIG. 1 is an exploded perspective view of a timing switch apparatus made in accordance with the principles of the present invention.

With continued reference to FIG. 1, it will be readily observed that timing switch means 32 which also forms part of the timing apparatus 10 is in electrical communication with respective ones of thermostatic switches 34 and 36. Thermostatic switches 34 and 36 are connected to furnace solenoid 16 by leads 18 and 38 and are effective to selectively and alternately operate the furnace solenoid 16 at two discrete temperature levels. For instance, thermostatic switch 34 may be the high temperature thermostat which whenever operated serves to actuate the furnace solenoid 16 to provide for the high temperature level. Alternately, thermostat switch 36 may define the low temperature thermostat which whenever closed will, of course, enable the low temperature setting of furnace solenoid 16 to take effect. As will be disclosed in the succeeding description, the timing switch 32 is continuously operated so as to alternately enable each of the thermostat switches 34 and 36 in the predetermined time intervals.

The preceding description is directed to an embodiment of timing apparatus 10 wherein timing switch 32 is operatively associated between transformer 12, timing motor 21 and the pair of thermostat switches 34 and 36. It should be mentioned that the present invention also envisions that a single thermostat could be appropriately operated instead of two thermostats to provide the desired high and low temperature settings. It will be understood that it is well within the purview of one skilled in the art to appropriately connect the timing switch apparatus 20 to the single thermostat, as well as modify the single thermostat for purposes of effectuating the dual temperature control. Consequently, a detailed description is not deemed necessary.

From the foregoing, it will be appreciated that should the power supplied from source 12 be interrupted, furnace solenoid 16 is temporarily incapable of operation, and there is also a cessation of alternating current to the trickle charger means 26. Nonetheless battery 22 continues to provide the primary source of power to appropriately operate, in a conventional fashion, motor mechanism 21 in controlled time intervals. Since the battery 22 is able to be virtually always recharged, it continuously and solely provides the requisite power to drive the timing mechanism 21 for an extended time, and the need for relatively frequently replacing the batteries, therefore, is significantly diminished.

Turning to FIGS. 1 to 5 of the drawing there is perhaps best depicted timing switch apparatus 20. As hereinafter basically described, the timing switch apparatus 20 includes switch means 32, supporting means 40, indicating means 42, and actuating means 44.

In connection with supporting means 40, reference is made, in particular, to FIG. 1. As depicted, supporting means 40 includes support plate 46 with apertures 48 and a generally V-shaped cut-out portion 50. Screws 51 cooperate with apertures 48, top plate for timing motor 21 and threaded openings (not shown) in a casing C (FIG. 5) for timing motor 21 so as to secure the support plate. In addition, such plate 46 includes a pair of spaced apart and generally parallel guide rails 52, integrally formed pairs of inner and outer switch blade guide members 54, a multiplicity of upstanding discrete support posts 56 which cooperate with switching means 32 and a support boss 58.

The present invention envisions that timing motor mechanism 21 may be of a battery operated type, which rotates its output shaft 60. In one reduction to practice, for example, a timing mechanism 21 could essentially be a quartz-based type battery operated timer for purposes of accuracy in timing and is modified as indicated below and commercially available from General Time Corporation of Davidson, N.C. Since the components forming the timing mechanism 21 are made of conventional material and are constructed and assembled in a known fashion, a detailed description thereof has been dispensed with. Such model may be modified in a conventional manner not forming part of this invention for rotating shaft 60 one revolution in 24 hours. Other time increments for rotating shaft 60 may, of course, be used. Timing mechanism 21 may be modified to permit setting thereof in either direction of rotation. Towards this end, a known type of clutch, also not shown, may be provided so that the timing mechanism 21 can be appropriately set whenever output shaft 60 is rotated in either direction. Of course, the foregoing brief description of one reduction to practice was given for purposes of illustration and should, therefore, not be considered as a limitation to the scope of the instant invention.

With continued reference to FIG. 1 indicating means 42 includes a pair of independently rotatable indicating arms 62, 62*a* which respectively have openings 64 formed at one end thereof for enabling mounting thereof on and rotation with or about output shaft 60. For instance, arm 62 could represent the high temperature setting arm, whereas arm 62*a* could represent the low temperature arm. The free ends of the arms 62, 62*a* are formed with upturned flange portions 66 having radially inwardly extending and overlying indication tabs 68. Tabs 68 have suitable indentifying indicia 70 thereon for purposes of facilitating the proper selection of timing sequences by which timing switch apparatus 20 will control the operation of the switching means 32. Arms 62, 62*a* are also provided with upturned segments which define driving pawls 72. Pawls 72 cooperate, in a manner to be presently mentioned, with motion transmitting means 74 for rotatably driving arms 62, 62*a* in one direction of rotation. Downwardly depending from each of the arms 62, 62*a* is an indicator trip pin, designated generally by reference numeral 76 for facilitating subsequent operative engagement of arms 62, 62*a* with actuating means 44.

Although this particular embodiment has disclosed a pair of indicating arms 62, 62*a* it is within the spirit and scope of the invention to have any suitable number of arms. For instance, if it is desired to provide for more than day and night control within which each of the thermostat switches 34 and 36 would be operable, a suitable number of additional indicating arms 62 could be provided to accomplish the desired selection.

It should also be pointed out that each of the trip pins 76 is radially spaced from a longitudinal axis 77 extending from output shaft 60 by a different preselected distance therefrom. The particular significance of such radial spacing will be soon discussed. Sandwiched between respective ones of the arms 62, 62*a* and mounted on shaft 60 is washer 78. Also, a spring washer 80 is disposed about shaft 60, but is situated beneath both indicating arms 62, 62*a*. Spring washer 80 is arranged to upwardly yieldingly bias arms 62, 62*a* and pawls 72 into firm frictional engagement with motion transmitting means 74 for purposes afterwards discussed.

As concerns motion transmitting means 74, such is defined by an adjustment knob 82 having a plurality of one-way driving ratchet teeth 84 formed on the bottom end surface thereof, and axially extending hub 86 with opening 88 therethrough for slidably receiving a partial portion of output shaft 60. Screw 90 removably secures knob 82 to a suitable threaded opening in shaft 60. In this particular manner, ratchet teeth 84 are correspondingly conjointly rotated with output shaft 60. Since spring washer 80 acts to yieldably maintain pawls 72 in operative engagement with one-way driving ratchet teeth 84, arms 62, 62*a* accordingly, rotate in unison with output shaft 60 in the driving direction.

A calibrated dial 92 bearing indicia representing predetermined divisions of time, for instance, hours, is suitable retained in a recess formed on knob 82. Towards the end of preselecting the time intervals of operation for operating thermostatic switches 34 and 36, it will be noted that tabs 68 can be appropriately manually advanced to the particular desired time settings on dial 92 by merely rotating the tabs so that the pawls 72 override the ratchet teeth 84. As a result of the foregoing, the trip indicating pins 76 are correspondingly rotatably advanced to different operative positions with respect to each other, and the indicating means 42 for purposes to be subsequently described.

In regard to switching means 32, the present embodiment discloses it to be a rather conventional form of single pole double throw switch 94 including cover 96 having suitable openings which slidably fit over support posts 56. In this manner switch 94 is mounted to support base 46. Switch 94 includes three generally parallel and spaced apart switch blades 98, 100 and 102. Center blade 100 is formed with a notch 104 at its free end. In the illustrated embodiment switch blade 98 is in electrical communication with high temperature thermostat 34, whereas thermostat 36 is electrically associated with switch blade 102. Support plate 46, as noted, is formed with elongated inner and outer guide members or pins 54. Basically, the inner pair of guide pins 54 function, in a conventional fashion, to prevent the outer switch blades 98 and 102 from undesirably following the center blade 100. Outer pins 54 are situated on the outside of switch blades 98 and 102, and by such positioning are able to prevent uncontrolled lateral displacement of such outer blades, which might otherwise have a tendency to cause opening or non-contact with central blade 100. While the preceding description of switch means 32 has concerned itself with a single pole double throw switch 94, this invention clearly envisions that other types of switch assemblies may also be advantageously utilized without departing from its spirit and scope.

Figure 2:
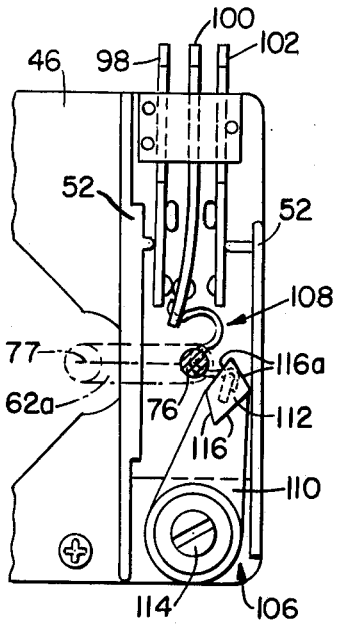
FIG. 2 is an enlarged diagrammatic view of certain of the components forming the timing switch apparatus shown in FIG. 1, in one particular position of operation.

With reference to FIG. 2 taken in conjunction with FIGS. 3–6 the actuating means 44 is shown to be comprised of camming means 106 and biasing means 108. Camming means 106 primarily includes oscillating arm 110 and cam member 112. Oscillating arm 110 is removable and rotatably connected to support boss 58, such as by a suitable screw 114, so as to permit lateral oscillating movement thereof. Guide rails 52 tend to limit uncontrolled oscillatory movement of arm 110. Cam member 112 is formed with a polygonal shape having opposed pairs of converging surfaces 116, 116*a* and is suitably connected at the end and top of oscillating arm 110. The radial inwardly disposed pair of generally flat camming surfaces 116 formed on cam member 112 operatively cooperate with the trip indicating pins 76 in a fashion to be presently described, for corresponding alternately moving oscillating arm 110 and center switch blade 100 between opposed first and second positions, and into corresponding contact with respective ones of the outer blades 98 and 102. In addition, the outwardly disposed pair of surfaces 116*a* is tapered so that cam member 112 will not obstruct continued rotation of trip pins 76.

Figure 4:
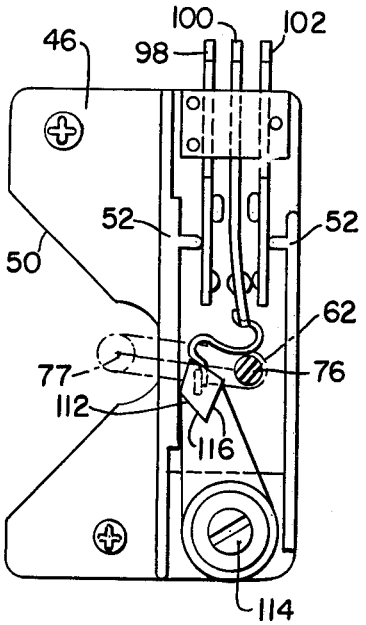
FIG. 4 is a view similar to FIGS. 2 and 3 but, however, illustrating the timing switch apparatus in yet another one of its operative positions.
Figure 5:
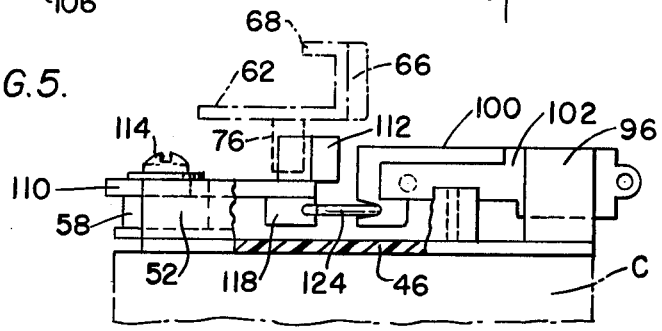
FIG. 5 is a side elevational view taken substantially along the lines 5—5 appearing in FIG. 3 looking in the direction of the arrows and further illustrating in greater detail the cooperation of the elements forming the timing switch apparatus.

Referring to FIG. 1 taken in conjunction with FIG. 5, there is best shown the biasing means 108. Essentially, such biasing means 108 produces a snapping action which effects greater reliability in the switching operation. Biasing means 108 includes spring retaining member 118, and compression spring means 120. Retaining member 118 is connected to and beneath oscillating arm 110 and has a recess 122 at its forward end. In this embodiment, the compression spring means 120 is defined by an S-spring 124 having opposed end tangs 126. The tangs 126, in a known fashion, are suitably connected to both notch 104 and recess 122 to enable retention of the S-spring 124, as the latter moves during oscillation of oscillating arm 110. By virtue of this particular arrangement, S-spring 124 is able to provide a snapping action to the center switch blade 100 for forcing such blade into and away from one of the outer switch blades 98 and 102 towards the opposite outer switch blade as more clearly noted in FIGS. 2 to 4. Essentially, such spring 124 by virtue of its characteristics effectively snaps or pivots the center blade 100 in a direction which is opposite to movement of oscillating arm 110. In addition, S-spring 124 by its inherent resiliency further serves to maintain center blade 100 in firm contact with outer blades 98 and 102 to thereby minimize the likelihood of the switch 96 being unintentionally opened during its normal operation. The present invention prefers an S-spring 124 type of compression spring, but includes within its scope other types of compression springs. It should be pointed out, however, that other types of compression springs have a tendency to snake during movement, whereas S-springs are able to avoid the difficulties of snaking which occur with other known compression springs by being able to, in effect, pivot.

Figure 3:
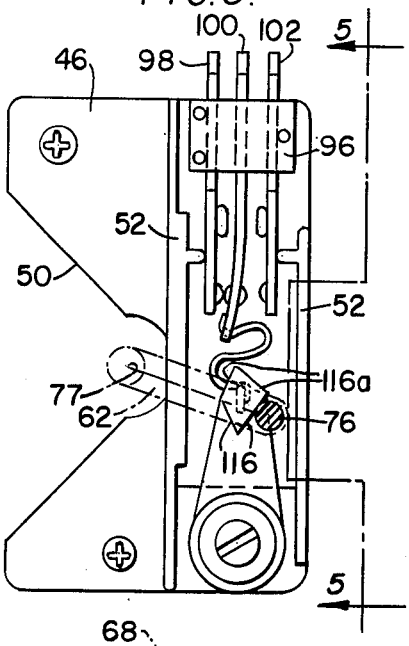
FIG. 3 is a view somewhat similar to FIG. 2 but, however, illustrating those components of the timing switch apparatus in another position of operation.

After having described the constructional arrangement of timing switch apparatus 20, the sequence of operations performed in alternately switching of thermostat switches 34 and 36 will be more clearly understood by continued reference to FIGS. 2 to 4. Assuming that the indicating arms 62, 62*a* have been properly set with respect to the desired calibrations on dial 92 by appropriately manipulating the tabs 68 so as to provide the preselected time intervals of operation desired for thermostat switches 34 and 36, it will be appreciated that upon suitable application of electrical power to timer motor 21, the output shaft 60 will rotate. Owing to the connection between ratchet teeth 84 and corresponding drive pawls 72, indicating arms 62, 62*a* are drivingly rotated simultaneously with the output shaft 60. Accordingly, trip indicating pins 76 will also be conjointly rotated.

As previously indicated, the respective pins 76 are at certain predetermined distances from the vertical axis 77 of output shaft 60. In the present embodiment, it is contemplated that each of the individual trip pins 76 be radially spaced such that a corresponding one will contact the inner pair of opposite cam surfaces 116 as they advance along their predetermined circular path. The trip indicator pin 76 associated with the high temperature indicating arm 62, (long) will contact one of the outer surfaces 116, as shown in FIG. 3 to urge oscillating arm 110 counterclockwise to the position as shown in FIG. 4. As a result of the foregoing, the S-spring 124 will, by virtue of its particular inherent resilient properties, snap the center switch blade 100 in the opposite direction from contact with outer switch blade 98 to outer switch blade 102.

Alternatively, with respect to the low temperature indicating arm 62*a* (short) the indicating trip pin 76 associated therewith will contact the inner camming surface 116 closest the axis 77 to force the arm 110 in the clockwise direction so that it moves from the position depicted in FIG. 4 and returns to the position indicated by FIG. 2. Similarly, S-spring 124 serves to snap or pivot the center switch blade 110 from contact with the outer switch blade 102 to contact with the opposite outer switch blade 98 for enabling thermostat 34 to operate.

As a consequence thereof, timing switch apparatus simply, advantageously, and reliably alternates switching of thermostat switches 34 and 36 in a preselected, coordinated and uninterrupted time sequence. From the foregoing, it is believed the operation of timing apparatus 10 as well as timing switch apparatus 20 is evident.

While the invention has been described in connection with a preferred embodiment it is not intended to limit the invention to the particular form set forth above, but, on the contrary, it is intended to cover such alternatives, modifications, and equivalents as may be included within the spirit and scope of the invention as defined by the appended claims.

What is claimed is:

1. Timing apparatus comprising motor means including a supporting member and rotatable output shaft rotatable through a revolution in a prescribed period of time, switching means operatively connected to said supporting member of said motor means for alternating switching between two discrete positions for respectively operating electrical output devices, indicating means operatively connected to said output shaft for movement in unison with said output shaft, and for selective independent movement with respect to said output shaft in response to adjustment for adjustably setting the times within said prescribed period of time at which said switching means will be operated to effect such switching between the electrical output devices, and actuating means operatively connected to said supporting member of said motor means, directly connected to said switching means and being operatively contacted by said indicating means for periodic movement between opposed first and second positions in response to displacement of said indicating means, said actuating means including biasing means for resiliently snapping and maintaining said switching means in either one of the two discrete positions whenever said actuating means is correspondingly in one of said first and second positions, said actuating means includes an oscillating arm connected to said supporting member of said motor means for oscillatory movement between said first and second positions, camming means directly connected to one end portion of said oscillatory arm and being positioned to be struck by said indicating means, said biasing means directly interconnecting said actuating means to said switching means for snapping said switching means to said either of the two discrete positions in response to said oscillatory movement of said oscillating arm.

2. The apparatus as set forth in claim 1 in which said indicating means includes a pair of separately movable indicating arms mounted for movement on said output shaft and each having driving pawls associated therewith, and an outwardly extending tripping pin for contacting said actuating means, and motion transmitting means having ratchet teeth and being fastened to said shaft for conjoint rotatable movement with said shaft, said ratchet teeth drivingly engaging said driving pawls in one direction of rotation of said output shaft and enabling said pawls to override said teeth in an opposite direction of rotation of said output shaft.

3. The apparatus as set forth in claim 2 in which each of said tripping pins is radially spaced from said output shaft by predetermined difference such that one of said pins on one of said arms is positioned to force said actuating means to said first position and the other of said pins is positioned to force said actuating means to said second position whenever said pins are rotated in said driving direction.

4. The apparatus as set forth in claim 1 in which said biasing means includes a retaining member attached to said oscillating arm and a compression spring having one end connected to said retaining member and the other end connected to said switch means.

5. An apparatus as set forth in claim 4 in which said compression spring is defined by an S-spring.

6. An apparatus as set forth in claim 4 in which said switch means is a single pole double throw switch.

* * * * *